US007303506B1

(12) United States Patent
Reynolds et al.

(10) Patent No.: US 7,303,506 B1
(45) Date of Patent: Dec. 4, 2007

(54) COMBINED VERTICAL AND HORIZONTAL ROPE CLIMBING APPARATUS

(76) Inventors: Lynn Reynolds, 300 Kahhl Cir., Wasilla, AK (US) 99654; Joseph F. Maestas, 300 Kahhl Cir., Wasilla, AK (US) 99654

( * ) Notice: Subject to any disclaimer, the term of this patent is extended or adjusted under 35 U.S.C. 154(b) by 0 days.

(21) Appl. No.: 11/328,608

(22) Filed: Jan. 10, 2006

(51) Int. Cl.
*A63B 7/04* (2006.01)
*A63B 21/008* (2006.01)

(52) U.S. Cl. ..... 482/37; 482/112

(58) Field of Classification Search ..... 482/35–37, 482/72, 111–118, 120, 92
See application file for complete search history.

(56) References Cited

U.S. PATENT DOCUMENTS 5,076,574 A * 12/1991 Johnson, Jr. ..... 482/37
5,380,258 A * 1/1995 Hawley, Jr. ..... 482/37
5,484,360 A * 1/1996 Haber et al. ..... 482/37
5,496,234 A * 3/1996 Sussich ..... 482/37
6,261,208 B1 * 7/2001 Carson, Jr. ..... 482/37
7,018,323 B1 * 3/2006 Reynolds et al. ..... 482/37
7,060,003 B1 * 6/2006 Reynolds et al. ..... 482/37
7,086,991 B2 * 8/2006 Williams et al. ..... 482/37
2005/0148437 A1 * 7/2005 Ryan et al. ..... 482/37

FOREIGN PATENT DOCUMENTS

GB 2341806 A * 3/2000

* cited by examiner

*Primary Examiner*—Jerome Donnelly
*Assistant Examiner*—Fenn C. Mathew
(74) *Attorney, Agent, or Firm*—Michael Tavella

(57) ABSTRACT

A combination horizontal and vertical rope-pulling device that uses a hydraulic braking assembly that is mounted on a vertical frame to support an endless rope that is placed over a number of pulleys. A pivoting boom is attached at the top of the frame. In the vertical mode, the rotating boom is positioned at an angle extending rearward from the vertical frame. The rope passes over a number of pulleys to simulate a vertical rope for climbing. In the horizontal mode, the rotating boom is rotated down so that it is parallel to the vertical frame. The rope follows the downward run of the boom and around the pulleys. In this way, the user can use the machine as a horizontal rope-pulling machine.

14 Claims, 6 Drawing Sheets

COMBINED VERTICAL AND HORIZONTAL ROPE CLIMBING APPARATUS

CROSS REFERENCE TO RELATED APPLICATIONS

This application claims the benefit under 35 U.S.C. 119(e) based on Provisional Application No. 60/609,894, filed Sep. 14, 2004.

STATEMENT REGARDING FEDERALLY SPONSORED RESEARCH AND DEVELOPMENT

Not Applicable

BACKGROUND OF THE INVENTION

1. Field of the Invention

This invention relates to rope pulling apparatus and particularly to a combination vertical and horizontal rope pulling apparatus using endless ropes.

2. Description of the Prior Art

Pulling ropes have been a part of fitness gyms for many years. Rope pulling is an excellent exercise for the wrists, hands and upper body. Traditionally, these ropes have been long (20 foot) lengths of rope that were suspended from a gym ceiling. There are two problems with the traditional fixed rope as an exercise tool. First, there are few buildings used for gyms today that have high enough ceilings. Second, a 20-foot length of rope does not provide enough sustained effort to enable someone skilled in rope pulling exercise to receive a sufficient workout. Once a person has reached the top of the rope, he or she must descend before he or she can climb again.

To overcome these difficulties, endless rope exercise machines have been invented. These devices use a frame, an endless length of rope and a means of resistance to simulate actual rope pulling. Such machines enable a user to "climb" a rope for as long as the user's stamina permits. U.S. Pat. No. 5,076,574 discloses a portable rope pulling exercise apparatus that has a frame, a series of pulleys supporting a rope, and a hydraulic brake system to provide resistance for the rope.

In addition to vertical rope pulling machines, it is also desirable to have horizontal rope pulling machines that can simulate a tug-of-war. One example of such a machine is found in U.S. Pat. No. 5,318,491, which shows a machine that has a rope extending from a control box. The box has parts that adjust the tension of the rope and the pulling force. The user stands on a treadmill. As the user pulls on the rope, the user moves on the treadmill. Alternatively, the treadmill can be locked for static rope pulling. The problem with this machine is that it is bulky with the treadmill. Moreover, although this device can simulate a tug-of-war, such a simulation is not the best exercise that can be obtained using a pulled rope. Finally, the displacement of the rope is such that it is not guarded. Thus, it appears that when not in use, the rope is left lying on the treadmill, which is a tripping hazard. In addition, the rope is dispensed through two holes that are narrowly spaced apart. This can lead to discomfort when the rope is under tension, because the loop may close on the user's hands.

Another horizontal pulling machine is found in GB 2,341,806. FIG. 3 of that patent shows the device. Here, a user reclines in a chair. A footrest is also provided to enable better pulling force. The endless rope is shown running from the front to the back, over a series of pulleys. The rope passes down and under the machine, where it then returns to the front and up again to the user. The problem with this machine is that the user must keep the rope to one side of the user's body. Thus, the user can exercise only one side at a time. In addition, the rope is shown passing under the user's arm on its way to the back of the machine. This is uncomfortable and may cause irritation and chaffing during use.

Although the vertical and horizontal machines exist, no machine combines the features of vertical and horizontal machines into one single machine. Such a machine can save space and lower costs by eliminating the extra machine.

BRIEF DESCRIPTION OF THE INVENTION

The instant invention overcomes all of these problems. It is a combination horizontal and vertical rope-pulling device. The machine uses a hydraulic braking assembly that is mounted on a vertical frame to support an endless rope that is placed over a number of pulleys. A pivoting boom is attached at the top of the frame. The boom has a fixed member that spaces the rotating boom from the vertical frame. In the vertical mode, the rotating boom is positioned at an angle extending rearward from the vertical frame. The rope passes over an upper pulley, and then runs back to a first guide pulley. It then runs up over a second guide pulley, where it then drops down to the horizontal frame. It then passes through a trough in the horizontal frame. The rope then passes through the vertical frame and then back to a braking pulley.

In the horizontal mode, the rotating boom is rotated down so that it is parallel to the vertical frame. The rope follows the downward run of the boom. Here, however, instead of passing over the second guide pulley, the user pulls the rope back using the first guide pulley as a guide. As before, the rope passes down through the trough in the horizontal frame and then back to the braking pulley. In this way, the user can use the machine as a horizontal rope-pulling machine.

DETAILED DESCRIPTION OF THE INVENTION

Figure 1:
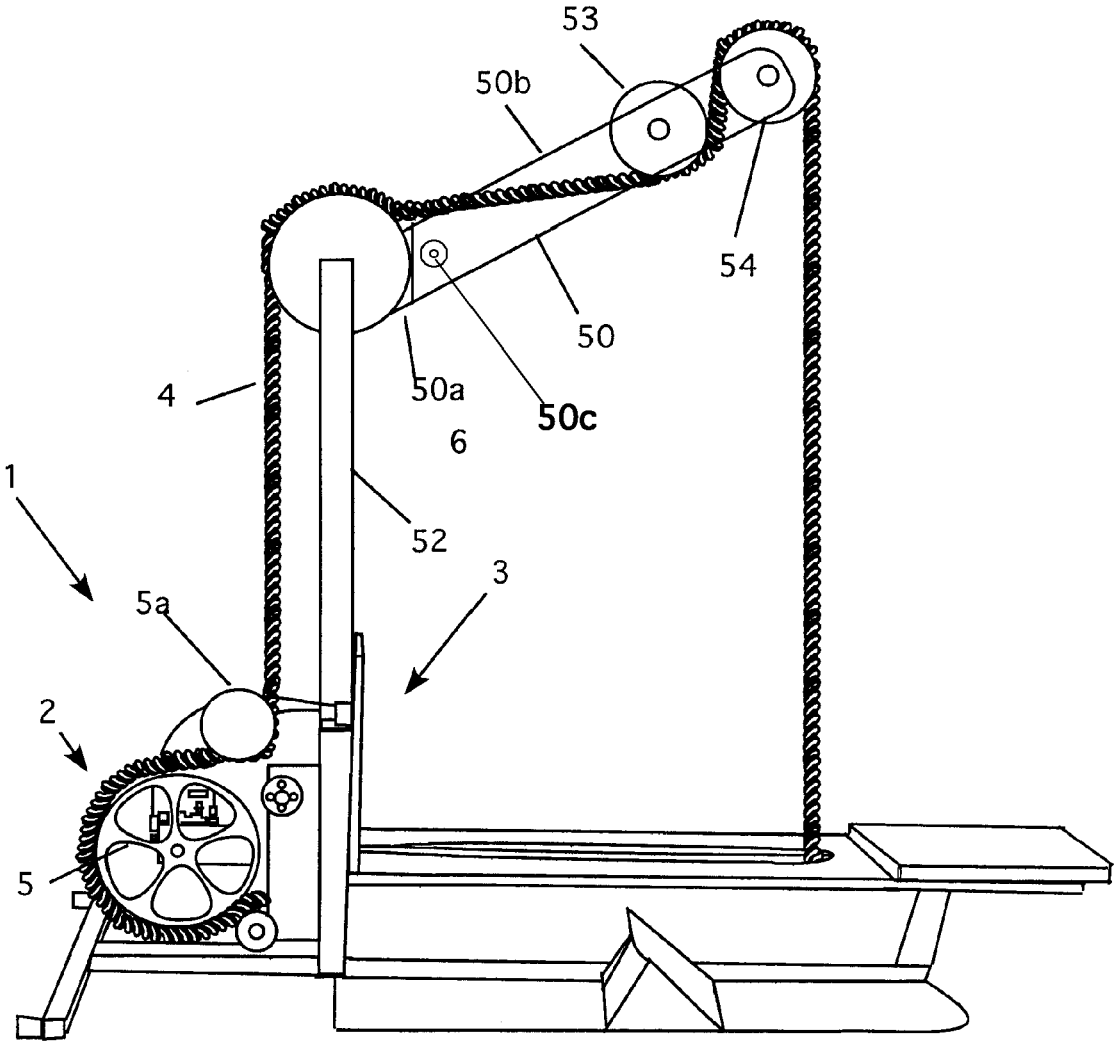
FIG. 1 is a side view of the invention in the vertical configuration.

Referring now to FIG. 1, the invention 1, is shown. The invention is a combination horizontal and vertical rope-pulling device. The machine uses a hydraulic braking assembly 2 (see FIGS. 2, 4, and 5) that is mounted on a frame 3 to support an endless rope 4 that is placed over a number of pulleys. The rope 4 passes over the pulley 5, which is the breaking pulley. The rope then passes back, over a transition pulley 5*a*. It rises vertically to an upper pulley 6. A pivoting boom 50 is attached at the top of the frame. The boom has a fixed member 50*a* that spaces the rotating boom 50*b* from the vertical frame 52. A pivot point 50*c* is also shown (see also FIG. 2). In the vertical mode, as shown in FIG. 1, the rotating boom 50*b* is positioned at an angle and extends rearward from the vertical frame 52. The rope passes over the upper pulley 6, and then runs back to the first guide pulley 53. It then runs up over the second guide pulley 54, where it then drops down to the horizontal frame. It then passes through a trough in the horizontal frame (discussed below). The rope then passes through the vertical frame and then back to the braking pulley 5.

Figure 2:
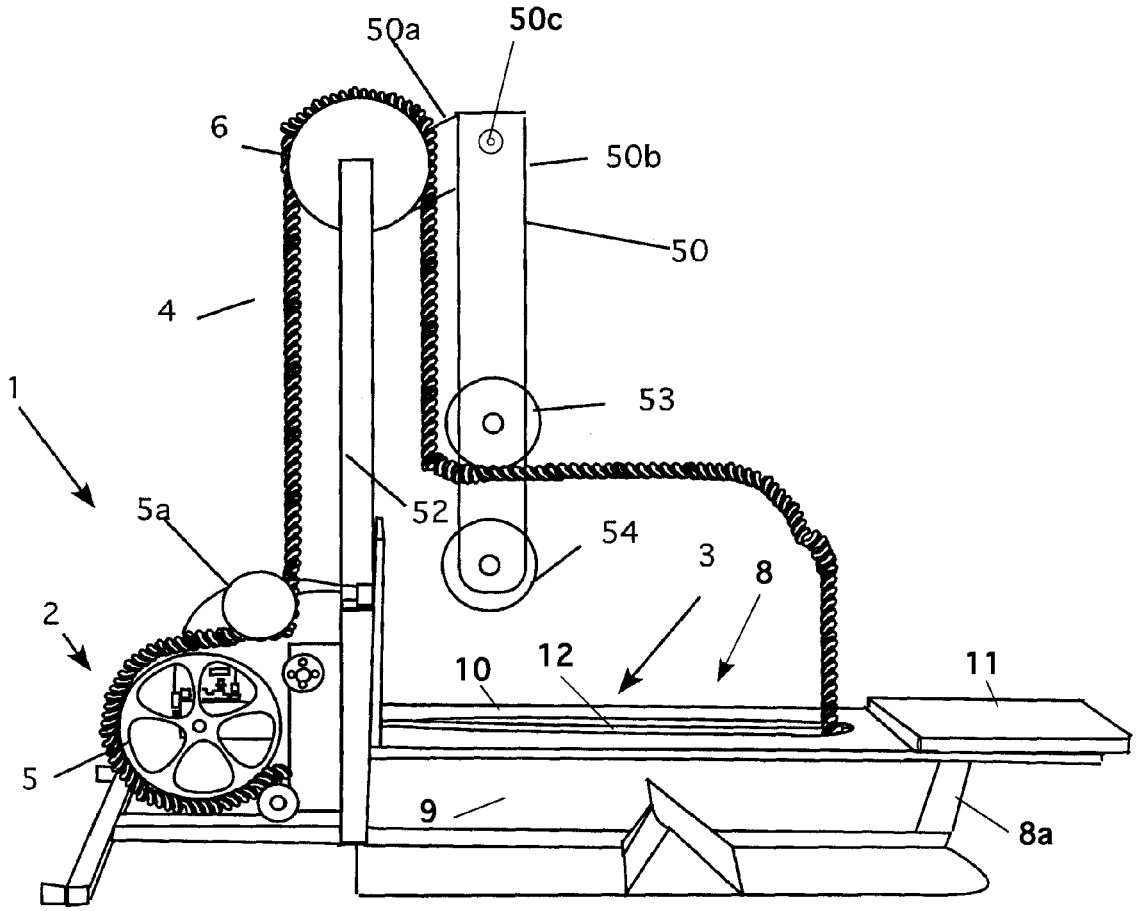
FIG. 2 is a side view of the invention in the horizontal configuration.

FIG. 2 shows the device in the horizontal mode. Here, the rotating boom 50*b* is rotated down so that it is parallel to the vertical frame. The rope follows the downward run of the boom. Here, however, instead of passing over the second guide pulley, the user pulls the rope back using the first guide pulley as a guide. As before, the rope passes down through the trough in the horizontal frame and then back to the braking pulley 5. In this way, the user can use the rope as a horizontal rope-pulling machine.

The horizontal frame 8 extends back from the vertical frame 52 as shown. It includes a top plate 10 and a seat 11. A support brace 8*a* elevates the seat 11 above the ground. Below the top plate 10 is a pair of plates 9 that frame a trough under the top plate 10. The top plate 10 has a slot 12 cut into it to allow the rope 4 to pass through as shown. The rope 4 runs down, under the top plate, through the trough, and through the vertical frame 52. It then runs to the pulley 5, completing the loop. The plates 9 can be made of metal or plastic.

Figure 3:
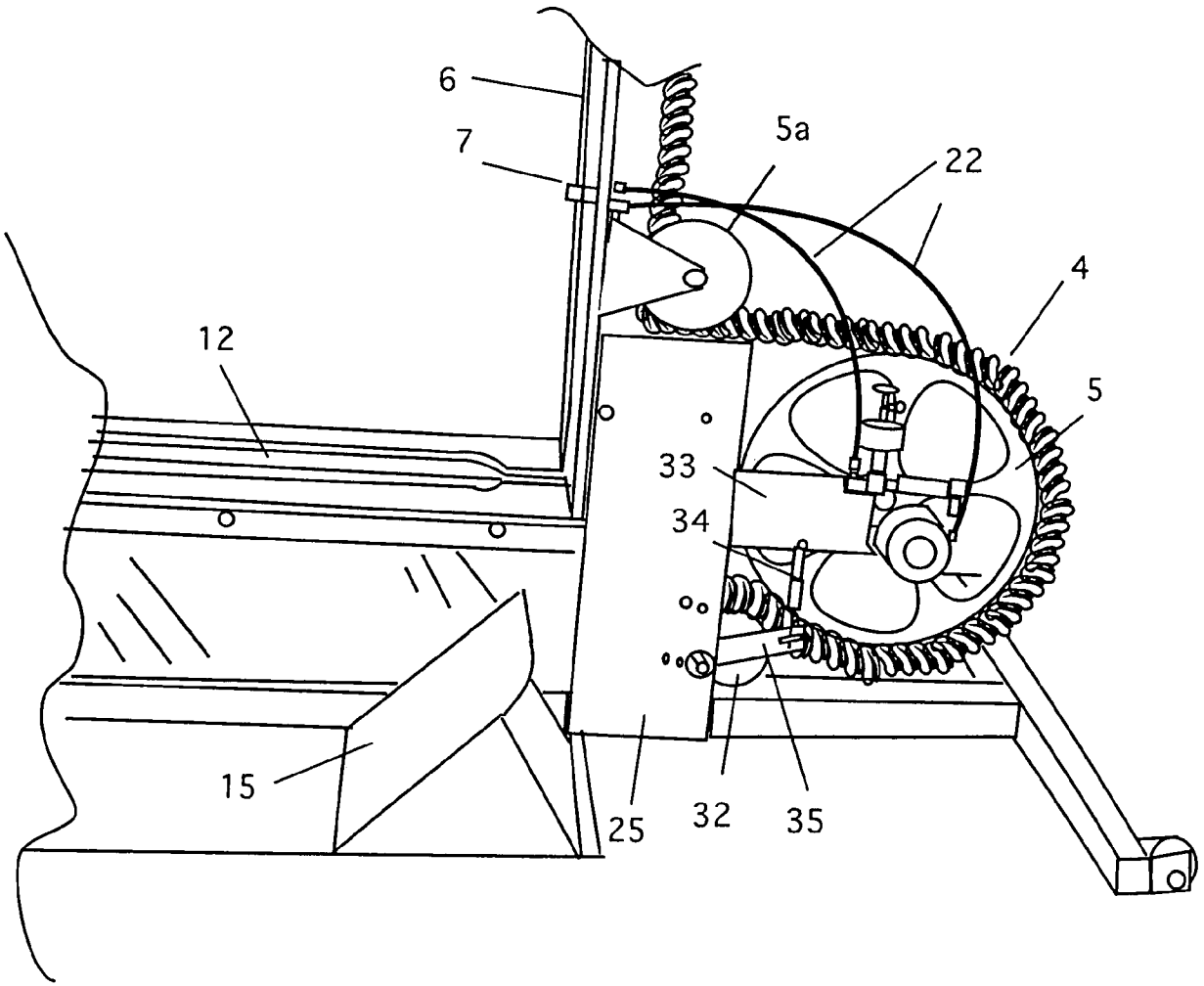
FIG. 3 is a right side detail view of the braking system for the invention.

FIG. 3 shows details of the tensioning and braking systems. A support plate 33 is attached to the right side guard plate 25. The plate 33 supports the hydraulic equipment. A vertical member 34 attached to a side lever 35, which, in turn, is attached to the tension pulley 32. As the tension is adjusted, member 34 raises and lowers the lever 35, which increases or decreases the contact of the pulley on the rope 4. The tensioning system is designed to keep tension on the rope to ensure it remains in contact over the pulley 5.

Figure 4:
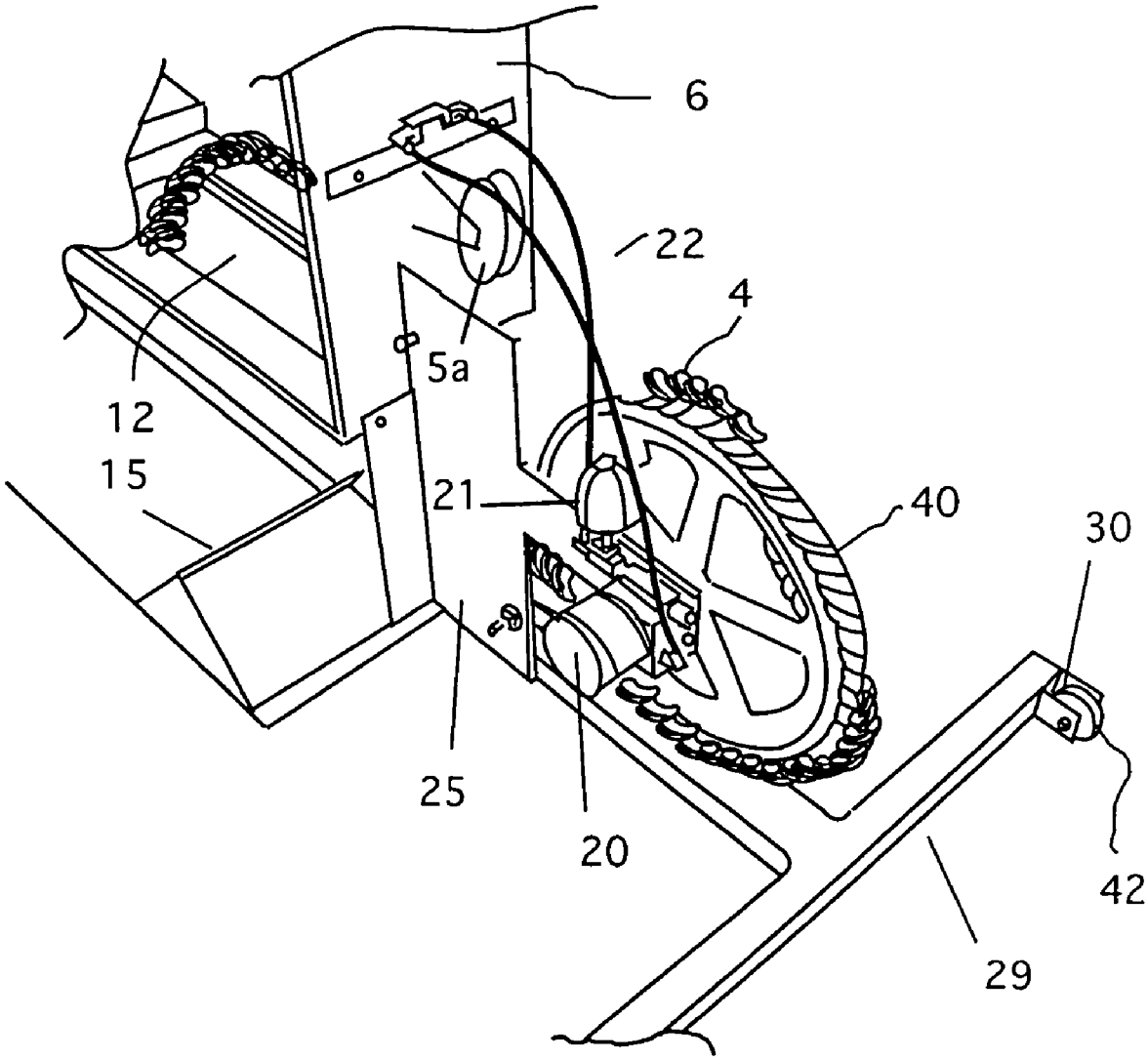
FIG. 4 is a right side perspective detail view of the front of the invention.

FIG. 4 shows additional details of the breaking system. It also shows a pulley 36, mounted in the base of the vertical frame to guide the rope through the vertical frame. Also shown in the figure is the right side guard 25. Note that the device has a base 14 that is part of the horizontal frame 8. This base 14 gives the machine stability, as well as providing a place for the user to place his or her feet. Footrests 15 are attached to base 14 on either side of the device as shown. The footrests allow a user to place the user's feet on the footrest while exercising. In this way, the user can lift up off the seat during a work out, providing better leverage when pulling the rope.

This figure also shows the braking system from the right side of the machine. Here, the hydraulic motor 20, the reservoir 21, the hydraulic lines 22 and the control knob 7 are shown. The hydraulic motor 20 is connected to the drive pulley 5 by a shaft. As the control is adjusted, the hydraulic system increases the amount of force needed to turn the main cylinder and the drive pulley. This increased force translates to increased pulling resistance experienced by the user. In this way, the amount of energy needed to pull the rope can be adjusted as desired by the user.

Note that FIG. 4 also shows details of the main pulley 5. In this view, the rope 4 is shown pulled away from the pulley 5. This shows the indentations 40 formed in the outer circumference of the pulley 5. These indentations are shaped like the rope and are designed to ensure a tight fit of the rope onto the pulley when it is under tension, to prevent the rope from slipping.

Figure 5:
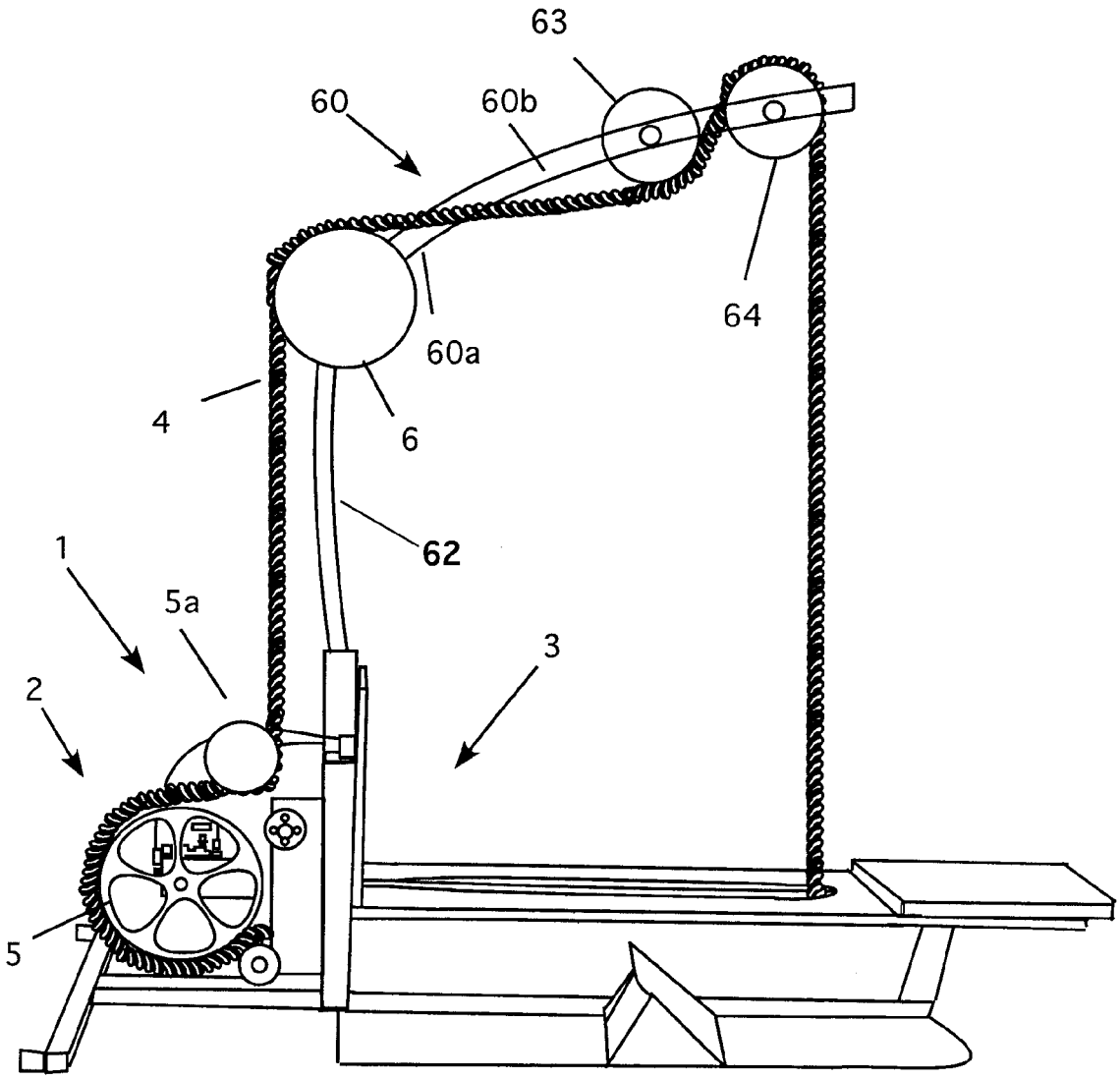
FIG. 5 is a side view of a second embodiment of the invention in the vertical configuration.

FIG. 5 is a side view of a second embodiment of the invention in the vertical configuration. In this embodiment, the vertical frame 62 and boom 60 are curved members. As before, the lower portion of the device is the same as in the first embodiment. The curved boom 60 has a fixed portion 60*a* and a rotating portion 60*b*. The guide pulleys 63 and 64 are also used as before.

Figure 6:
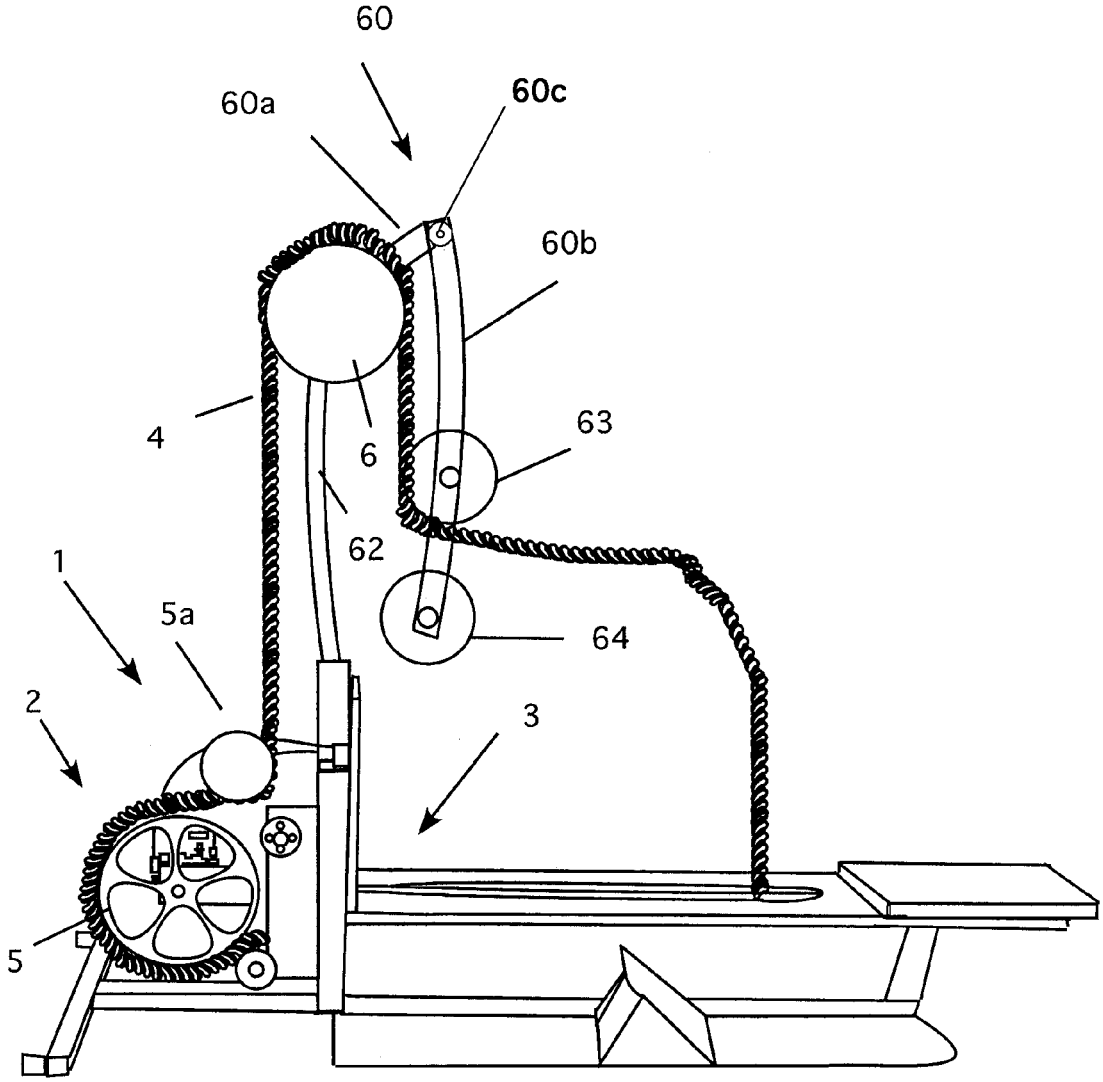
FIG. 6 is a side view of the second embodiment of the invention in the horizontal configuration.

FIG. 6 is a side view of the second embodiment of the invention in the horizontal configuration. Here, the rotating portion 60*b* is rotated down to its lower position on pivot point 60*c*. It is then parallel with the vertical frame. Note that the rope passes down and through the boom as before so that it can be used in the horizontal mode.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A combined vertical and horizontal rope climbing and pulling apparatus comprising:

a) a frame having a vertical portion and a horizontal portion, said vertical portion having a top and a bottom, said horizontal portion having a front and a back, said bottom of said vertical portion having an opening therein, said horizontal portion also having an opening formed therein, said frame being assembled such that the bottom of said vertical portion is aligned with the front of said horizontal portion;

b) a braking mechanism, having an inlet end and an outlet end, attached to said frame;

c) a horizontal boom, pivotally attached to said vertical portion of said frame, said horizontal boom having at least one means for guiding an endless rope thereon;

d) a means for securing said horizontal boom in a first position, in which said horizontal boom extends outward from the top of said vertical portion in an orthogonal plane thereto and also being parallel to said horizontal portion;

e) a means for securing said horizontal boom is a second position, in which said horizontal boom extends downward from the top of said vertical portion and lies substantially parallel thereto; and f) an endless rope, said endless rope being positioned about said frame as follows; said endless rope being in operative engagement with said braking mechanism, extending outward from said outlet end of said braking mechanism, passing over said one means for guiding an endless rope on said horizontal boom, passing through said opening in said horizontal portion of said frame, passing through said opening in the bottom of said vertical portion and passing to said inlet of said braking mechanism.

2. The rope climbing apparatus of claim 1 wherein said horizontal boom is in said first position, whereby said rope climbing apparatus is a vertical rope climbing apparatus.

3. The rope climbing apparatus of claim 1 wherein said horizontal boom is in said second position, whereby said rope climbing apparatus is a horizontal rope pulling apparatus.

4. The exercise device of claim 1 further comprising a seat, attached to horizontal portion of said frame.

5. The exercise device of claim 1 further comprising a footrest, attached to said horizontal portion of said frame and extending upwardly therefrom.

6. The exercise device of claim 1 wherein the breaking mechanism includes a drive pulley having an outer surface.

7. The exercise device of claim 6 wherein the breaking mechanism further includes a means for controlling the force applied to said drive pulley.

8. The exercise device of claim 7 wherein the means for controlling the force applied to said drive pulley includes:

a) an hydraulic pump; and b) a valve, in hydraulic communication with said pump.

9. The exercise device of claim 8 further comprising a reservoir, in hydraulic communication with said pump.

10. The rope climbing apparatus of claim 1 wherein said horizontal boom is a substantially straight member.

11. The rope climbing apparatus of claim 1 wherein said horizontal boom is a substantially arctuate member.

12. The exercise device of claim 6 wherein the outer surface of said drive pulley includes a gripping surface for said endless rope.

13. The exercise device of claim 12 wherein the endless rope is comprised of a plurality of interlaced strands having an outer surface.

14. The exercise device of claim 13 wherein the gripping surface comprises a plurality of indentations configured to accept the outer surface of said plurality of interlaced strands.

* * * * *